United States Patent [19]

Maehara

[11] Patent Number: 4,605,167

[45] **Date of Patent: * Aug. 12, 1986**

[54] ULTRASONIC LIQUID EJECTING APPARATUS

[75] Inventor: Naoyoshi Maehara, Nara, Japan

[73] Assignee: Matsushita Electric Industrial Company, Limited, Japan

[ * ] Notice: The portion of the term of this patent subsequent to Aug. 6, 2002 has been disclaimed.

[21] Appl. No.: 458,881

[22] Filed: Jan. 17, 1983

[30] Foreign Application Priority Data

Jan. 18, 1982 [JP] Japan ..... 57-6284
Feb. 10, 1982 [JP] Japan ..... 57-20030
Jun. 23, 1982 [JP] Japan ..... 57-107901

[51] Int. Cl.[4] ..... B05B 3/14

[52] U.S. Cl. ..... 239/102; 346/140 R; 431/1

[58] Field of Search ..... 239/4, 102; 431/1; 346/75, 140 PD; 261/DIG. 48; 310/DIG. 1, 328

[56] References Cited

U.S. PATENT DOCUMENTS 2,855,244 10/1958 Camp ..... 239/102
3,683,212 8/1972 Zoltan ..... 310/8.3
3,738,574 6/1973 Guntersdorter et al. ..... 239/102
3,747,120 7/1973 Stemme ..... 346/75
3,790,079 2/1974 Bergbund et al. ..... 239/102
3,848,118 11/1974 Rittberg ..... 239/102
4,153,201 5/1979 Berger et al. ..... 431/1
4,245,225 1/1981 Fillmore et al. ..... 239/102
4,264,837 4/1981 Gaboriaud ..... 239/102
4,364,070 12/1982 Matsuda et al. ..... 346/140 PD

FOREIGN PATENT DOCUMENTS 234335 6/1961 Australia .
476961 9/1976 Australia .
491245 3/1978 Australia .

*Primary Examiner*—Andres Kashnikow
*Assistant Examiner*—Kevin Patrick Weldon
*Attorney, Agent, or Firm*—Lowe, King, Price & Becker

[57] ABSTRACT

An ultrasonic liquid ejecting apparatus for discharging liquid droplets comprises a housing including a chamber for holding liquid therein having an intake port connected to a liquid supply container. A bimorph vibrator system is provided comprising a vibrating member secured to the housing in pressure transmitting relation with the liquid in the chamber and a piezoelectric transducer secured to the vibrating member for inducing a displacement therein to discharge a small quantity of liquid through an nozzle opening formed in the vibrating member. A circuit is provided for exciting the transducer at a frequency corresponding to the resonant frequency of the vibrator system.

13 Claims, 18 Drawing Figures

ULTRASONIC LIQUID EJECTING APPARATUS

BACKGROUND OF THE INVENTION

The present invention relates to an ultrasonic liquid ejecting apparatus for discharging liquid in the form of diverging streams or a single jet stream depending on various applications in which the apparatus is used. The invention is useful for universal applications including fuel burners and printers.

A piezoelectric oscillating system for effecting atomization of liquids is described in U.S. Pat. No. 3,738,574. Such a piezoelectric oscillating system comprises a piezoelectric transducer mechanically coupled by a frustum to a vibrator plate for inducing bending vibrations therein, a fluid tank and a pump for delivering fluid to the vibrating plate which is disposed at an oblique angle with respect to the force of gravity above the tank. A wick is provided to aid in diverting excess liquid from the plate to the tank. The frustum serves as a means for amplifying the energy generated by the transducer. To ensure oscillation stability, however, the frustrum needs to be machined to a high degree of precision and maintained in a correct position with respect to a conduit through which the pumped fluid is dropped on the vibrator plate and the amount of fluid to be delivered from the pump must be accurately controlled. Further disadvantages are that the system is bulky and expensive and requires high power for atomizing a given amount of liquid. In some instances 10 watts of power is required for atomizing liquid of 20 cubic centimeters per minute, and yet the droplet size is not uniform.

U.S. Pat. No. 3,683,212 discloses a pulsed liquid ejection system comprising a conduit which is connected at one end to a liquid containing reservoir and terminates at the other end in a small orifice. A tubular transducer surrounds the conduit for generating stress therein to expel a small quantity of liquid through the orifice at high speeds in the form of a stream to a writing surface.

U.S. Pat. No. 3,747,120 discloses a liquid ejection apparatus having an inner and an outer liquid chamber separated by a dividing plate having a connecting channel therein. A piezoelectric transducer is provided rearward of the apparatus to couple to the liquid in the inner chamber to generate rapid pressure rises therein to expel a small quantity of liquid in the outer chamber through a nozzle which is coaxial to the connecting channel.

While the liquid ejection systems disclosed in U.S. Pat. Nos. 3,683,212 and 3,747,120 are excellent for printing purposes due to their compact design, small droplet size and stability in the direction of discharged droplets, these systems have an inherent structural drawback in that for the liquid to be expelled through the nozzle the pressure rise generated at the rear of liquid chamber must be transmitted all the way through the bulk of liquid to the front of the chamber, so that bubbles are produced by cavitation if the liquid contains a large quantity of dissolved air. As a result satisfactory operation is not sustainted for long periods.

Copending U.S. patent application Ser. No. 434,533, filed Oct. 14, 1982 by N. Maehara et al, titled "Arrangement for Ejecting Liquid, and assigned to the same assignee of the present invention discloses a liquid ejecting device comprising a housing defining a liquid chamber, a ring-shaped piezoelectric transducer and a vibrating member secured to the transducer in pressure transmitting relationship with the liquid in the chamber.

SUMMARY OF THE INVENTION

The present invention is directed to an improvement over the aforesaid Copending U.S. application.

The ultrasonic liquid ejecting apparatus of the invention comprises a housing including a chamber for holding liquid therein having an intake port connected to a liquid supply container, and a vibrator system including a vibrating member secured to the housing in pressure transmitting relation with the liquid in the chamber and having at least one nozzle opening therein and a piezoelectric transducer secured to the vibrating member for inducing therein a displacement to discharge a small quantity of liquid through the nozzle opening. Means are provided for exciting the transducer at a frequency corresponding to the resonant frequency of the vibrator system. The operating efficiency of the liquid ejecting device is maximized by the resonant vibration of the vibrator system.

According to one feature of the invention, the piezoelectric transducer is in the form of a ring and electrically polarized in the direction of thickness, the nozzle opening being located coaxially with the aperture of the ring so that the ring-shaped transducer and an outer area of the vibrating member form an outer part of the vibrator system and the inner area of the vibrating member located inside the aperture forms an inner part of the vibrator system, the mechanical impedance of the outer part substantially equals the mechanical impedance of the inner part.

BRIEF DESCRIPTION OF THE DRAWINGS

The present invention will be described in further detail with reference to the accompanying drawings, in which.

DETAILED DESCRIPTION

Figure 2:
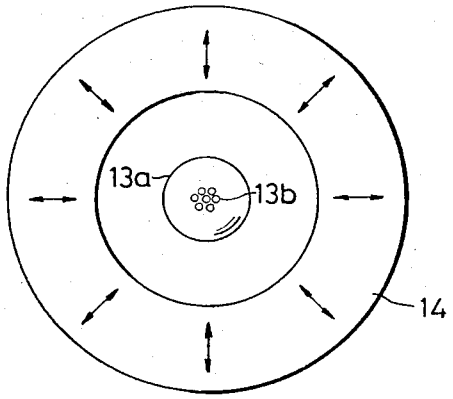
FIG. 2 is a front view of the FIG. 1 embodiment.
Figure 1:
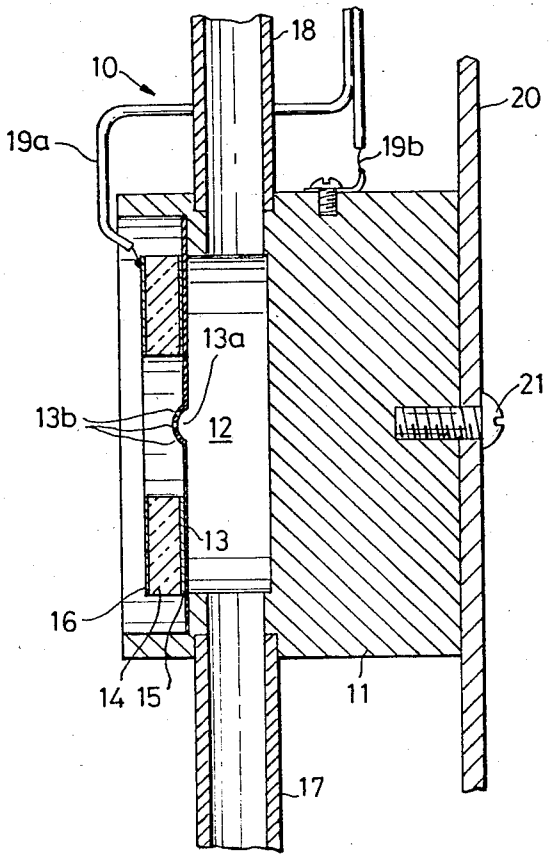
FIG. 1 is a cross-sectional view of a first preferred embodiment of the liquid ejection device of the invention taken along the axial direction thereof.

Referring now to FIG. 1, there is shown a first embodiment of the liquid ejection unit of the invention. The liquid ejection unit, generally indicated at 10, is particularly suitable for use in atomizing fuel or the like and comprises a metallic body 11 formed with a liquid chamber 12 having a diameter of 5 to 15 milimeters and a depth of 1 to 5 millimeters. An axially vibrating nozzle disc 13, preferably formed of a thin metal film having a thickness of 30 to 100 micrometers, is secured to the perimeter of chamber 12, defining a front wall of chamber 12. To the front surface of the nozzle disc 13 is cemented a ring-shaped piezoelectric transducer 14, leaving the center portion of the nozzle disc 13 to be exposed to the outside. The transducer 14 is of a piezoelectric ceramic which is polarized in the axial direction so that upon application of a potential to the electrodes 15 and 16 vibration occurs therein in radial directions as illustrated in FIG. 2. The transducer 14 has an outer diameter of 5 to 15 millimeters, an inner diameter of 2 to 8 milimeters and a thickness of 0.5 to 2 milimeters. For ejecting liquids in diverging trajectories the center portion of the nozzle plate 13 is curved outward as shown at 13*a* and provided with a plurality of nozzle openings 13*b* each having a diameter of 30 to 100 micrometers. The transducer 14 is provided with a pair of film electrodes 15 and 16 on opposite surfaces thereof. The chamber 12 is in communication with a liquid supply conduit 17 which is in turn connected to a liquid supply source and is connected by a conduit 18 to an air chamber the function of which will be described later. Connections are made by wires 19*a* and 19*b* from a circuit which will be described later to the electrodes of the piezoelectric transducer 14. The body 11 is secured to a suitable support 20 by a screw 21.

Figure 3:
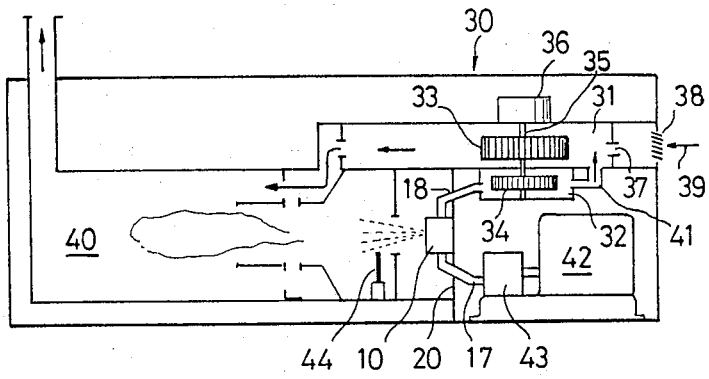
FIG. 3 is a cross-sectional view of a fuel burner in which the liquid ejection unit of FIG. 1 is mounted.

According to one application of the invention, the liquid ejection unit 10 is mounted in a fuel burner 30 as illustrated in FIG. 3. The burner 30 comprises a first chamber 31 and a second chamber 32. Fans 33 and 34 respectively located in the chambers 31 and 32 are coupled by a shaft 35 to a fan motor 36. The first chamber 31 is open at the right end to the outside through an orifice 37 and an air inlet opening 38 to draw in air as indicated by arrow 39 so that the pressure in chamber 31 is reduced below the atmospheric pressure and the downstream end of the chamber 31 is in communication with a combustion chamber 40. The second chamber 32 is connected at one end by a conduit 41 to the first chamber 31 and connected at the other end by the conduit 18 to the liquid ejection unit 10. A fuel tank 42 supplies fuel to a leveler 43 which serves to maintain the fuel supplied to the unit 10 under a constant pressure regardless of the volume of fuel in the tank 42.

When the motor 36 is not energized, the fuel in the conduit 17 stands at a level slightly below the unit 10. With the motor 36 being energized, the fan 33 causes the upstream end of first chamber 31 to drop to a subatmospheric pressure of typically −10 mmAg and the fan 34 forces air into the upstream end of first chamber 31 through conduit 41 while at the same time causing a pressure difference of typically −30 mmAg to occur between the right and left end of second chamber 32. Therefore, the static pressure in conduit 18 drops to −40 mmAg drawing the liquid in conduit 17 upward through the chamber 12 of unit 10 into the conduit 18 and the head of the liquid therein is maintained thereafter. The chamber 12 is thus filled with liquid which is maintained at a static pressure equal to or lower than the static pressure in front of nozzle disc 13. In a typical embodiment the static pressure of the liquid is kept at −10 mmAg to −20 mmAg lower than the pressure in front of the nozzle disc. Located forwardly of the unit 10 is an ignitor 44 to cause ignition of fuel droplets. Complete combustion occurs in the combustion chamber 40 by mixture with air introduced through the first chamber 31.

Figure 4:
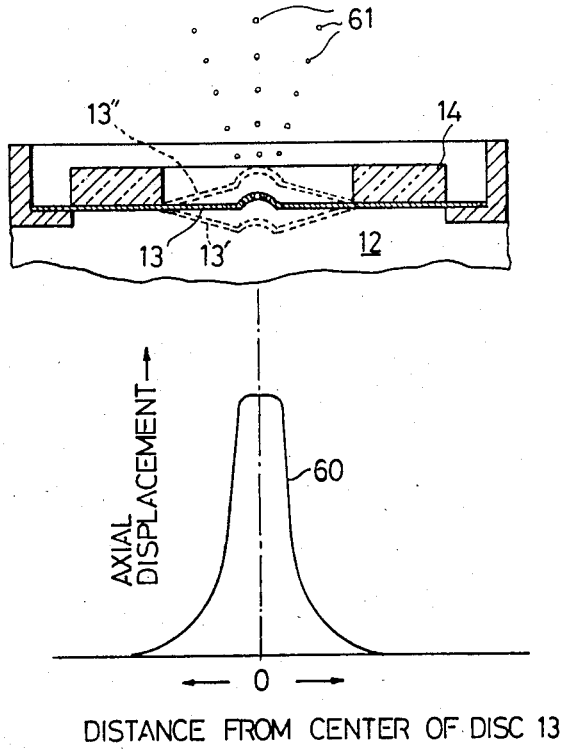
FIG. 4 is an illustration useful for describing the operation of the invention.

The operation of the liquid ejection unit 10 will be described in more detail with reference to FIG. 4.

Upon application of a high frequency burst signal to the transducer 14 vibration occurs in radial directions therein to cause nozzle disc 13 to deflect rearward as shown at 13' to generate a pressure rise in the liquid causing a small amount of liquid near the nozzle openings to be discharged therethrough in the form of diverging streams of droplets at high speeds as indicated at 61. The nozzle disc 13 is then deflected forward as shown at 13'' to produce a pressure decrease until the pressure in liquid balances against the surface tension at the nozzle openings 13*b* with the result that liquid is sucked into the chamber 12 through conduit 17. Most of the energy applied to the transducer 14 is converted to an axial displacement of the nozzle disc 13 having a sharp increase at the center portion of disc 13 as indicated by a curve 60 compared with the displacement at the edge thereof.

Due to the fact that the vibrating structure of the invention is mounted forwardly of the liquid chamber in pressure transmitting relation with the liquid, the ejection unit can be operated at such a high frequency in the range of 30 kHz to 100 kHz described above. If the liquid contains a large quantity of dissolved air cavitation would occur when the nozzle disc 13 is displaced forward. Since the vibration occurs at the forward end of the liquid chamber 12, the pressure rise tends to concentrate in the vicinity of nozzle openings 13*b* and bubbles tend to move away from the pressure concentrated area, so that the liquid ejecting device of the invention is unaffected by bubbles even if air is dissolved in the liquid chamber 12.

The conduit 18 also serves as a means for venting such bubbles to the outside. This arrangement is particularly useful when liquid such as kerosene is used since it contains a large amount of dissolved air.

It is found that if the static liquid pressure in chamber 12 is higher than the near atmospheric pressure immediately forward of nozzle disc 13, nozzle disc 13*e* fails to vibrate satisfactorily and liquid spills off. However, such undesirable circumstances are avoided by the action of air chambers 31 and 32 which maintains the liquid in chamber 12 at a constant static pressure equal to or lower than the static pressure in front of the nozzle as described in connection with FIG. 3.

Detailed description of the operation of the nozzle disc 13 and transducer 14 will now be described.

Figure 5A:
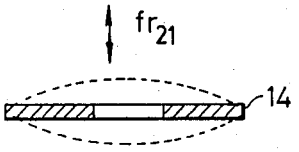
FIG. 5*a* to 5*f* are illustrations of vibrational modes of the bimorph system.
Figure 5D:
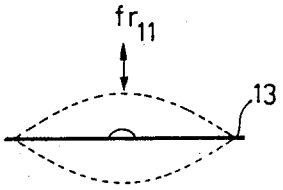
Figure 5B:
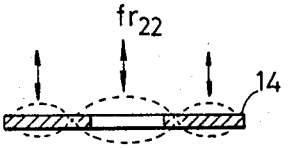
Figure 5E:
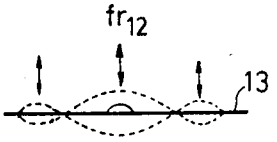
Figure 5C:
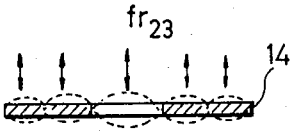
Figure 5F:
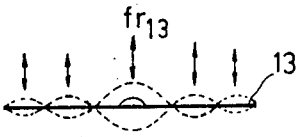

While the piezoelectric transducer 14 itself vibrates in radial directions as shown in FIG. 2, such radial vibration is converted into an axial displacement since the nozzle disc 13 and transducer 14 are considered to form a bimorph system which generates two sets of different vibrational mode patterns as illustrated in FIGS. 5*a*–5*c* and 5*d*–5*f*. The mode pattern shown in FIG. 5*a* is primarily generated by the outer part of the bimorph system which is formed by the transducer 14 and the outer area of the nozzle plate 13 when the system is excited at a frequency corresponding to the resonant frequency $fr_{21}$ of the outer part of the bimorph system. The mode patterns shown in FIGS. 5*b* and 5*c* are generated in the same area when the system is excited at frequencies corresponding to the second and third harmonics $fr_{22}$ and $fr_{23}$ of the outer part of the system. The mode pattern shown in FIG. 5*d* is primarily generated by the inner part of the bimorph system formed by the area of the nozzle plate 13 inside of the aperture of the transducer 14 when the system is excited at a frequency corresponding to the resonant frequency $fr_{11}$ of the inner part of the bimorph system. The mode patterns of FIGS. 5*e* and 5*f* are generated when the system is excited at frequencies corresponding to the second and third harmonics $fr_{12}$ and $fr_{13}$ of the inner part of the system.

Figure 6:
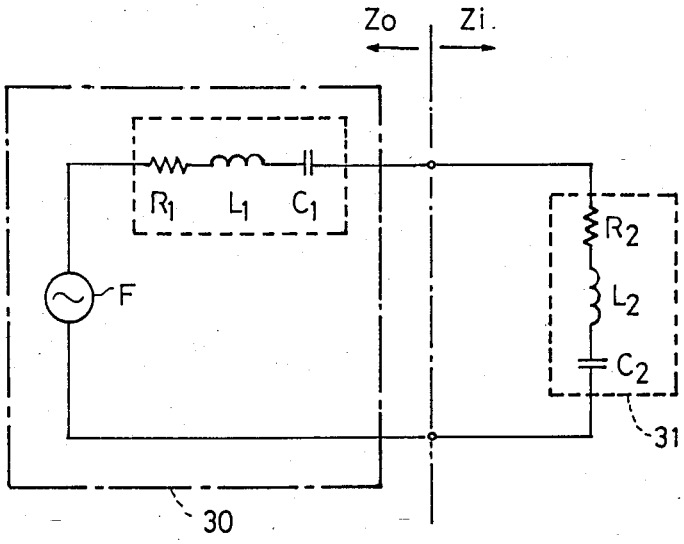
FIG. 6 is an illustration of an equivalent circuit of the bimorph system.

FIG. 6 shows the equivalent circuit of the bimorph system as comprising two series resonance circuits 30 and 31 coupled in series to a source of electromotive force F which represents the driving power applied to the transducer 14. The resonance circuit 30 corresponds to the outer part of the bimorph system and is formed by a mechanical resistance $R_1$, a mass $L_1$ and a compliance $C_1$ and the resonance circuit 31 corresponds to the inner part of the system and is formed by a mechanical resistance $R_2$, a mass $L_2$ and a compliance $C_2$.

Preferably, the mechanical impedance Zo of the outer part of the bimorph system equals the mechanical impedance Zi of the inner part of the system to maximize the operating efficiency of the system as follows:

$$Zo=Zi$$

$$R_1+j(2\pi fo.L_1-\tfrac{1}{2}\pi fo.C_1)=R_2+j(2\pi fo.L_2-\tfrac{1}{2}\pi fo.C_2),$$

where fo is the frequency at which the system is excited.

Figure 7:
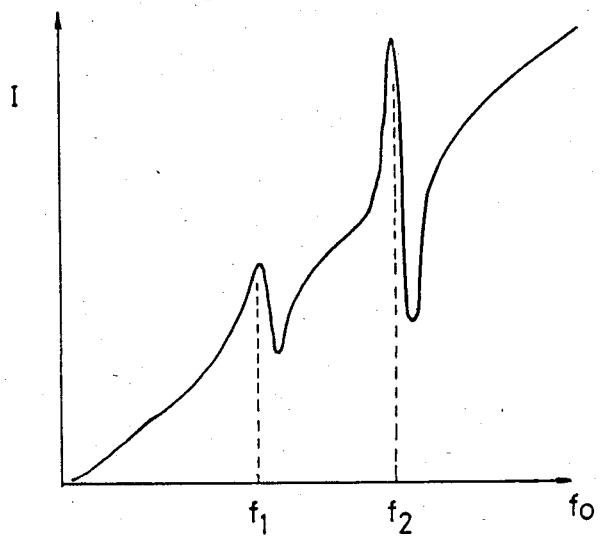
FIG. 7 is a graphic illustration of the current induced in a piezoelectric transducer as a function of the frequency at which it is excited.

FIG. 7 is a graphic representation of the current generated in the transducer 14 which was measured as a function of the operating frequency fo. It is seen that the current has lower and higher peak values at low and high frequencies $f_1$ and $f_2$, respectively. It is most preferred that the outer and inner parts of the bimorph system are respectively dimensioned so that the fundamental resonant frequency of the outer part substantially corresponds to the second harmonic of the resonant frequency of the inner part. Experiments show that the higher peak at frequency $f_2$, typically 50 kHz, is obtained when $fr_{21}$ nearly equals $fr_{12}$. Thus, the operating frequency is in a range of 45 kHz to 55 kHz.

Figure 8A:
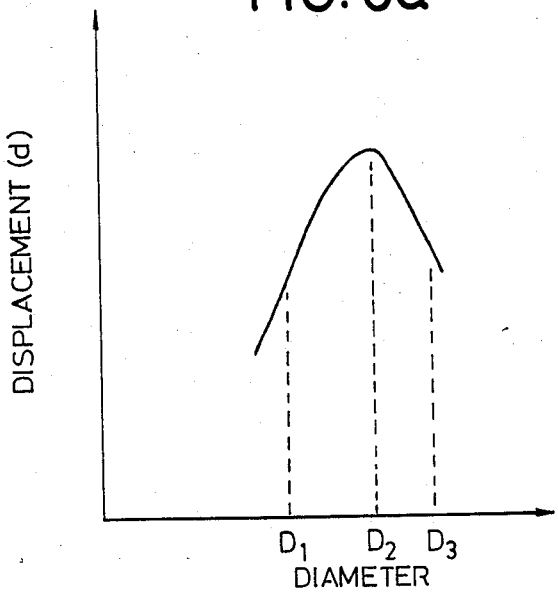
FIGS. 8*a* and 8*b* are graphic illustrations of the axial displacement of the transducer as a function of its outer diameter and as a function of its exciting frequency, respectively.
Figure 8B:
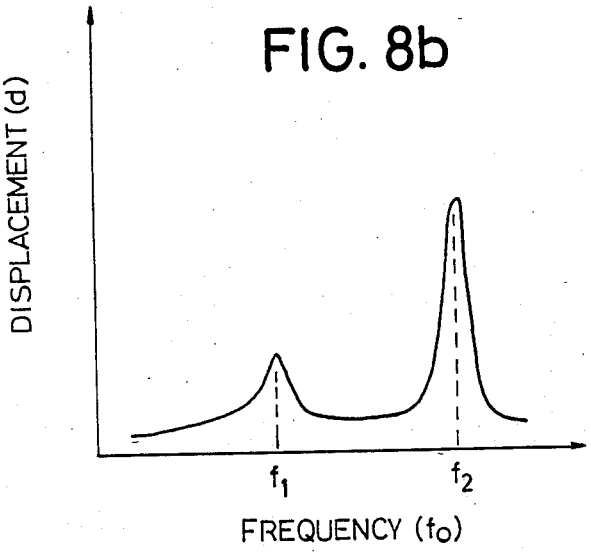

To ascertain this relationship, liquid ejection devices having transducers of a different outer diameter were experimentally constructed and the amount of axial displacement at the center of nozzle 13*b* were measured by exciting the transducer 14 at a given constant frequency. As shown in FIG. 8*a*, the axial displacement d is at maximum when the transducer 14 has a diameter $D_2$. With the transducer having the diameter $D_2$, the axial displacement d was measured by varying the operating frequency fo. FIG. 8*b* shows that the axial displacement reaches a maximum when the operating frequency coincides with $f_2$.

Figure 9:
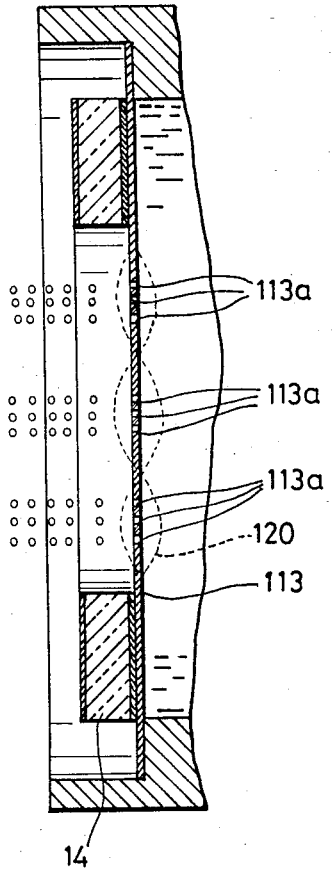

FIG. 9 is an illustration of a modified form of the present invention which allows a large amount of fluid to be ejected. The liquid ejection device 10 of FIG. 9 comprises a nozzle plate 113 having a plurality of groups of nozzle openings 113*a*, the nozzle openings of each group being located in positions substantially corresponding to antinodes of the vibration indicated by a broken lines 120. The transducer 114 has an aperture of a dimension sufficient to cause the inner part of the nozzle plate 113 to vibrate in the mode of second harmonic (FIG. 5*e*) at frequency $fr_{12}$.

The liquid ejection devices 10 of the invention of FIGS. 1 and 9 are particularly useful for application in kerosene heaters due to the fact that kerosene contains a substantial amount of dissolved air which tends to produce cavitation. By reason of the provision of the bimorph vibration system at the forward end of the device, only a small amount of kerosene located adjacent the nozzle area is needed to be displaced for ejection. As a result, the presence of bubbles, if any, in the liquid chamber does not affect the operation of the device. The device further requires a small amount of power for operation.

Figure 10:
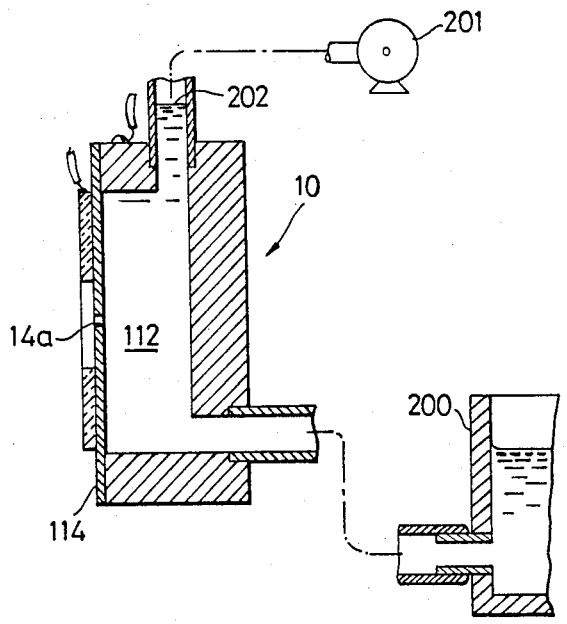
FIGS. 9 to 11 are illustrations of modified embodiments of the liquid ejecting device.

The device 10 is modified in a manner as shown in FIG. 10 so that the nozzle disc 114 has a single nozzle 114*a* for discharging a single stream of ink jet onto a writing surface such as recording sheet in a printer or facsimile. The liquid chamber 112 is in communication with an ink supply 200 which may be located below the device 10 and with a suction pump 201 which sucks the ink to a level indicated at 202 higher than the liquid chamber.

Figure 11:
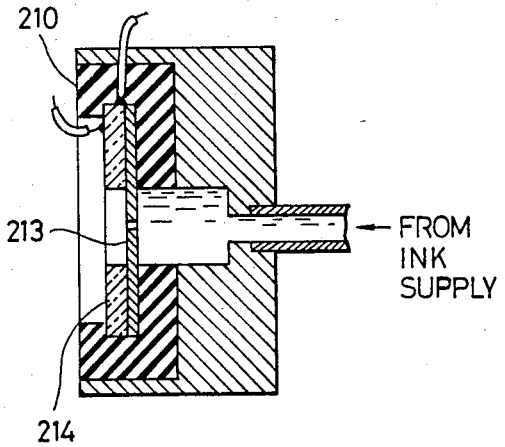

FIG. 11 is a further modification of the liquid ejection device in which a single-nozzle bimorph vibrator system formed by elements 213 and 214 is snapped into an elastic body 210 formed typically of rubber.

Figure 12:
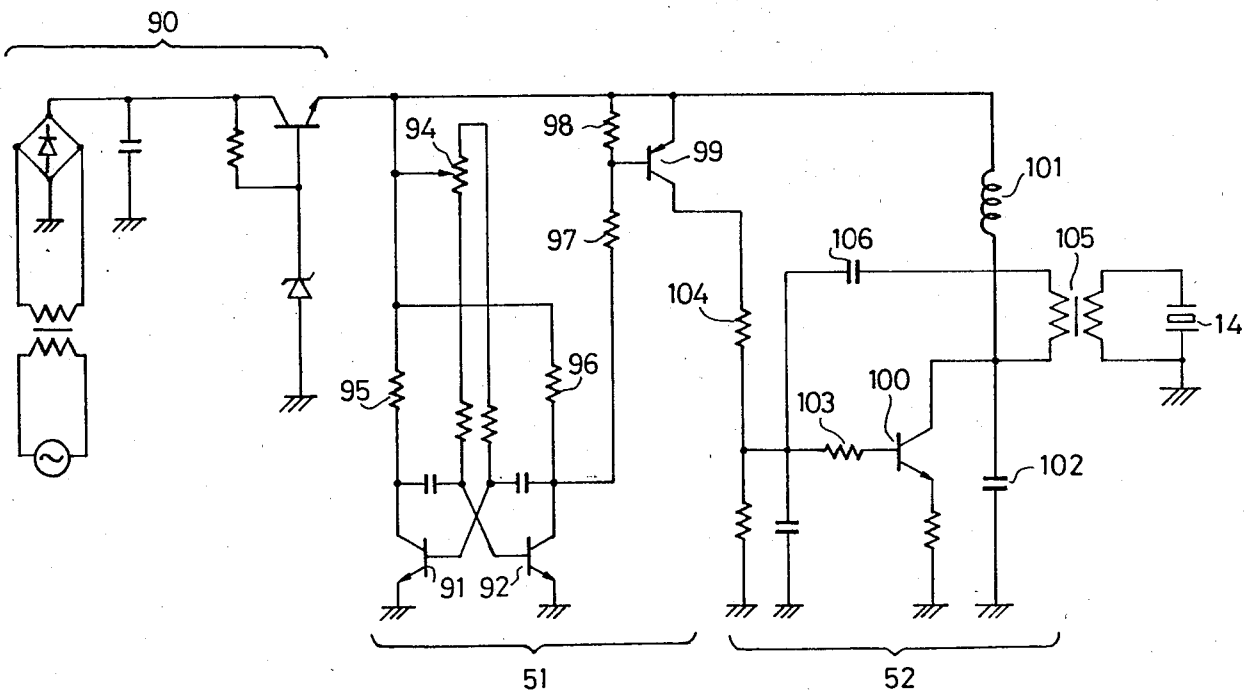
FIG. 12 is a diagram of a circuit for exciting the transducer.

FIG. 12 illustrates an electrical circuit that drives the transducer 14 for fuel burner applications. Emitter-grounded transistor 91 and 92 are cross-coupled to form a variable frequency multivibrator oscillator 51. A potentiometer 94 through which the base of transistor 91 is connected to the base of transistor 92 serves as a manual control device for setting the duty ratio of the multivibrator to determine the amount of liquid to be ejected. The wiper terminal of potentiometer 94 is connected to a voltage stabilized DC power source 90. The collectors of transistors 91, 92 are connected together by resistors 95 and 96 to the DC power source 90. The voltage developed at the collector of transistor 92 is coupled by voltage dividing resistors 97 and 98 to a switching transistor 99. A high frequency unipolar pulse generator 52 is provided comprising a transistor 100 whose collector is connected to a junction between an inductor 101 and a capacitor 102 and whose base is connected through resistors 103, 104 and through the collector-emitter path of transistor 99 to the DC power source so that transistor 100 is switched on and off in response to the on-off time of transistor 99. The collector of transistor 100 is connected by a feedback circuit including the primary winding of a transformer 105, capacitor 106 and resistor 103 to the base thereof. The secondary winding of transformer 105 is connected to the piezoelectric transducer 14 of unit 10. An ultrasonic frequency signal (30 kHz to 100 kHz) is generated in the oscillator 52 during periods when the transistor 99 is turned on. The circuit of FIG. 12 can be readily modified by replacing the variable frequency oscillator 51 with a similar circuit that responds to an information signal to vary its duty ratio.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. An ultrasonic liquid ejecting apparatus comprising:

a housing including a chamber for holding liquid therein having an intake port connected to a liquid supply container;

a vibrator system including a vibrating member secured to said housing in pressure transmitting relation with the liquid in said chamber so that the vibrating member defines a front wall of said chamber and having at least one nozzle opening therein and a piezoelectric transducer secured to said vibrating member for inducing therein a displacement at each vibration to discharge a small amount of liquid through said nozzle opening;

means in communication with said chamber for maintaining static pressure therein at a value equal to or lower than pressure in front of the vibrating member; and means for exciting said transducer at a frequency substantially equal to the resonant frequency of said vibrator system.

2. An ultrasonic liquid ejecting apparatus as claimed in claim 1, wherein said means in communication with said chamber is operable for maintaining the static pressure therein at a value equal to or lower than the atmospheric pressure.

3. An ultrasonic liquid ejecting apparatus as claimed in claim 1, further comprising an elastic mount secured to said housing for mounting said vibrator system.

4. An ultrasonic liquid ejecting apparatus as claimed in claim 1, wherein said transducer is formed of a ceramic and adhesively secured to said vibrating member.

5. An ultrasonic liquid ejecting apparatus as claimed in claim 1, wherein said exciting means comprises means for generating unipolar pulses at a frequency equal to said resonant frequency.

6. An ultrasonic liquid ejecting apparatus as claimed in claim 5, wherein said exciting means comprises means for interrupting said unipolar pulses at intervals.

7. An ultrasonic liquid ejecting apparatus as claimed in claim 1, wherein said vibrator system includes means operable to discharge said liquid through said nozzle opening in a forward drive mode formed of said vibrating member defining the front wall of said chamber.

8. An ultrasonic liquid ejecting apparatus as claimed in claim 7, wherein said means operable to discharge said liquid is operable for creating a pressure rise in the rearward direction for causing the liquid to be forwardly ejected in reaction thereto.

9. An ultrasonic liquid ejecting apparatus as claimed in claim 1, wherein said piezoelectric transducer is in the form of a ring and is electrically polarized in an axial direction thereof, and wherein said nozzle opening is located coaxially with the aperture of the ring so that the ring-shaped transducer and an outer area of said vibrating member form an outer part of the vibrator system and the inner area of said vibrating member located inside said aperture forms an inner part of the vibrator system, said inner and outer parts having fundamental resonant frequencies which are substantially equal to each other.

10. An ultrasonic liquid ejecting apparatus as claimed in claim 9, wherein said vibrating member is formed with a plurality of groups of apertures, the apertures of each group being located in the aperture of the ring-shaped transducer in a position corresponding to an antinodal point of the vibrating member.

11. An ultrasonic liquid ejecting apparatus as claimed in claim 9, wherein said vibrator system has a second harmonic resonant frequency which is substantially equal to the fundamental resonant frequencies of said inner and outer part.

12. An ultasonic liquid ejecting apparatus as claimed in claim 9, wherein the mechanical impedance of said outer part substantially equals the mechanical impedance of said inner part.

13. An ultrasonic liquid ejecting apparatus as claimed in claim 12, wherein said outer part of the vibrator system is arranged to vibrate at a frequency equal to the resonant frequency of said outer part.

* * * * *